US005175968A

United States Patent [19]

Saucke

[11] Patent Number: 5,175,968

[45] Date of Patent: Jan. 5, 1993

[54] POST-TRIMABLE PRE/TENSIONED STRESSED ARCHITECTURAL MEMBER

[75] Inventor: Terry L. Saucke, 904 Jahr Ave., Portland, N. Dak. 58237

[73] Assignee: Terry L. Saucke, Portland, N. Dak.

[21] Appl. No.: 755,145

[22] Filed: Sep. 5, 1991

[51] Int. Cl.[5] ..... E04C 3/18

[52] U.S. Cl. ..... 52/223 L; 52/223 R; 52/225; 52/226

[58] Field of Search ..... 52/225, 226, 227, 228, 52/229, 730, 223 R, 223 L

[56] References Cited

U.S. PATENT DOCUMENTS

| | | | |
|---|---|---|---|
| 2,510,958 | 6/1950 | Coff | 52/225 |
| 3,251,162 | 5/1966 | Strimple | 52/730 |
| 3,568,380 | 3/1971 | Stocky | 52/223 |

*Primary Examiner*—David A. Scherbel
*Assistant Examiner*—Matthew E. Leno
*Attorney, Agent, or Firm*—Robert VonHeck

[57] ABSTRACT

This invention provides an improvement related to the well known prestressed-concrete structural member, such as is commonly employed by the construction industry to achieve greater load-supporting ability for beams, columns and the like. Presently, laminated wooden-beams for example, are being mass-produced which exhibit a substantially increased load-bearing ability over an equivalent non-laminated beam. However, the physical dimensions and weight encountered in some applications can not only impose severe architectural design comprises, owing to beam-thickness to walk-under clearance; but often, requirement for special heavy-duty handling equipment at the site as well, owning to their inherent weight/mass. This invention serves not only to reduce the preceding problems, but to reduce problematical installation guess-work by enabling the builder to conveniently trim the beams ends to fit exact site installation spans, spans -without effecting the pretensioned integral truss-element.

5 Claims, 1 Drawing Sheet

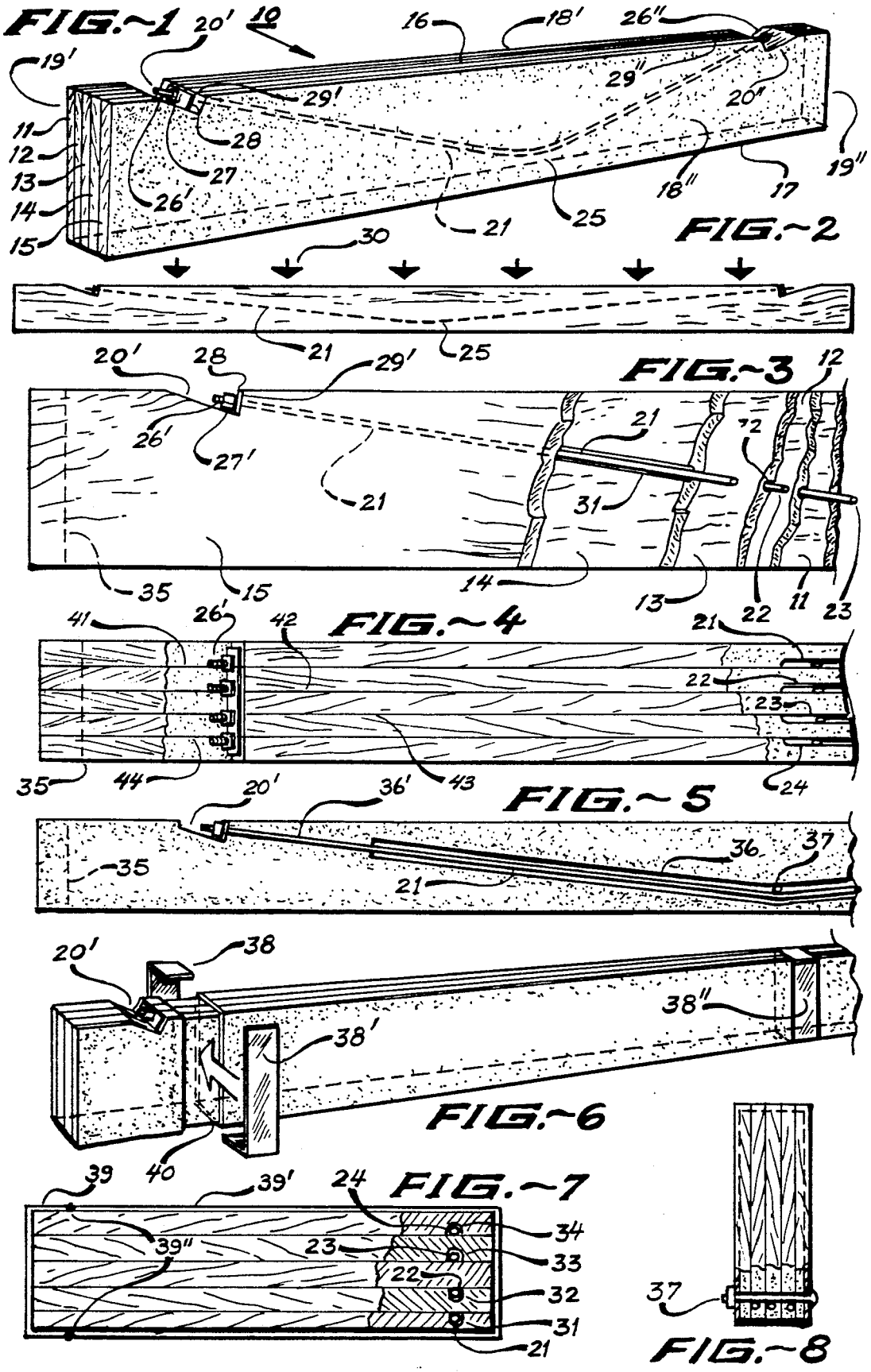
FIG.~1
FIG.~2
FIG.~3
FIG.~4
FIG.~5
FIG.~6
FIG.~7
FIG.~8

POST-TRIMABLE PRE/TENSIONED STRESSED ARCHITECTURAL MEMBER

BACKGROUND OF THE INVENTION

This invention generally relates to post-tensioned methods of prestressing architectural structural members; and more specifically, it relates to improved tension-strength for laminated wooden-beams and wooden-columns, and their manufacturing.

Heretofore, several related structural members have been patented which have been variously adapted in the construction of buildings, bridges, mines, tunnels, walls, and the like which consist primarily of concrete. By casting in a manner of tension-rod having opositively threaded ends with tensioning nuts thereon, a company could manufacture a concrete-beam for example; and, because concrete is relatively strong in compression, yet comparatively weak in tension, achieve greatly enhanced structural quality by essentially transfering applied weight bearing loads internally into the pre-tensioned element encased therein. Thus with the concrete medium able to thereby easily withstand the extra beam compression-loading imposed by the special pre-tensioning element therein, it may be readily understood that up to the ultimate compression/burst-strength-(radial fracturing relative to the axis of the encased tensioning element) of a given concrete specimen, the beam's useful load-bearing capacity would be manifoldly enhanced via the prestressing (albeit preloading in an opposite resistive manner as it were) technique.

The usefulness of such an improved structural member, which indeed may be throught of as a cousin to the older Pratt-truss(often used in both roof and bridge construction as a primary supporting longeron), is apparent in the substantially lighter architectural designs which have emerged into presense since the inception of this advancement, which is now part of standard international textbook engineering.

A good early example of this technology, is seen in U.S. Pat. No. 1,441,970(filed—June/1920) where the French-inventor devised a clever assembly of bricks, framed by a wooden perimeter, whereby the integrity of a brickwork panel was maintained via a plurality of spaced tensioning-rods(having tightening nuts on each end) which ran both latitudinally and longitudinally(-thereby creating an invisible internal gridwork of prestressed tension elements). Not to be outdone, German industrialist Hugo Junkers is shown to have introduced U.S. Pat. No. 1,895,667(filed—March/1929) for a hi-performance composite-metal assemblage as a much more light-weight structural beam like member; albeit a bit complex.

Some 3-decades Later, an American inventor set forth U.S. Pat. No. 3,029,490(filed—November/1954) for an improved "post-tensioning method for pre-stressing members", and some fifteen drawing-figures deal primarily with a simplified method of casting multipul deflected type tensioning-elements therein, in a uniformly spaced manner; thereby enhancing the concrete-beam's performance.

Shortly thereafter, another American inventor claimed U.S. Pat. No. 3,003,217(filed—February/1957) as "an apparatus for manufacturing prestressed concrete members", which again deals primarily with the more effective deflectedly down-draped encased tension-element; and a special method by which to automatically maintain a more consistant degree of tension regardless as to subsequent curing-contraction of the concrete-beam substance.

Most relevant, U.S. Pat. No. 3,251,162(filed—January/1962) shows a laminated-wood beam of prestressed/post-tensioned configuration, wherein the tendon or truss-element is extended entirely to the opposed vertical ends of the various generic beam embodiments disclosed. Also shown are different arrangements for use of transverse/truss-pins, which serve to take-up tensioning load-vectors of the truss-elements. Accordingly, this configuration imposes certain dire installation limitations, which the instant disclosure hereof serves to overcome.

Interestingly, U.S. Pat. No. 4,362,589(filed—November/1981) shows a special automated-mill methodology of making a large fabricated wooded I-beam of tapered configuration, useful in making long-span truss or joists for the floors or ceilings of a building.

Still, be that all as it is, large wooden solid-beams are often an aesthetic preference alternate for many architects. However, in more recent years, because of the general unavailability of larger trees today, and their hi-cost when available, mills have resorted to a very practical if not more effective type of wooden-beam, known as the multiply/laminated-beam.

Accordingly, this instant inventor has devised means by which to likewise further improve the load-bearing performance of modern laminated-beams to surprising advantage, as shall now be set forth; and, is currently being developed under the tradename "Tension-Tech" TM /laminated-beam via auspices of Saucke-Construction Co./Portland, N. Dak. The first such improved beam was officially installed into this inventor's house back in August of 1987, and is observed to be providing excellent results.

SUMMARY OF THE INVENTION

A. In view of the foregoing discussion about the earlier related invention art, it is therefore important to make it clear to others interested in the art that the object of the invention is to provide an architecturally attractive alternative to the well known prestressed/-concrete-beam, in the improved form of a substantially conventionally laminated(well known multi-ply glued-up proceedure) wooden-beam,—wherein is provided a specially integrated deflectedly-draped post-tensioned prestressing element. It is thus intended that this beam be employed not only as a horizontal floor/ceiling-joist, but diagonally and vertically as well; hence, as a general architectural member serving a variety of structural purposes. Accordingly, the primary object of this invention is to set forth special techniques combining certain known materials and methods, achieving surprising new and useful results.

B. Another object of this invention is to provide a substantially solid wooden based architectural structural member of laminated multi-ply construction, which exhibits substantially different physical characteristics than that of the heretofore well known ferrocement/prestressed-beam. For example, it is known that a cast-cement beam exhibits an approximate 2½%/Shrinkage-rate upon having substantially dried(-cured), and are rather extraordinarily heavy owing to their inherently high specific-gravity factor of nearly 1.50 as compared to only about 0.50/specific-gravity for common western-pine lumber for example. However, while no substantial weight is saved over known prestressed laminated-wood beams, the improvment embodiments of this invention disclosure does provide the convenience of accessibility, to retension the integrated truss-element in the event such attention were needed during the life of the installation. Access to the tensioning devices(such as a threaded nut) may be readily achieved in places, such as open-beam ceilings, where the beams are employed as the horizontal truss-members for example; which is not attainable with any known prestressed beam.

C. Another object of this invention, is to set forth a special prestressed plywood-beam member, in which the necessary internally laid(in well known deflectedly-draped fashion, so as to exert a desired resulting upward counter-component force) tensioning-element's ply-channel (or alternately, a hollow internal ply-space with an offset bias-pin to impose the deflection) extending substantially the longitudinal dimension of the beam.

D. Another object of this improved prestressed-beam configuration resides in a further convenience advantage of site installation. a. Whereas a prestressed/concrete-beam must necessarily be cast(typically at the factory) to the exact span dimension required at the site, b. the prestressed/plywood-beam may be made at a specialized remote factory location, delivered to the site in a slight nominal(generally a few inches) overlength dimension,—then simply "trimmed" to the exact fit-at-site dimension! Thereby, realizing potentially greater additional cost-effectiveness advantage, since common coordination(liaison) errors, and subtle engineering changes, often result in serious budgetary penalties when there is no built-in tolerance for error(what do you do when a number of precast/concrete-beams turn out to be an agonizing bit to short)!

E. Another object of this invention, is to set forth a special prestressed/plywood-beam to which still other finishing objects, such as drilled holed for convenient location of other hanger-brackets can be applied without appreciable weakening of the beam integrity as is the adverse case with conventional prestressed concrete beam structural members.

F. Another object of this invention, is to set forth a special prestressed/plywood-beam structural member which can be constructed with any kind of wood, or a combination of woods(particularly if for example a rough-hewn redwood ply were desired to be provided at opposite transverse external sides of the beam for aesthetic purposes, while a less costly structural wood were employed as the allied internal-ply members); and conventionally treated for any necessary ground-contact, fire-rating, or anti/insect-infestation.

G. Another object of this invention, is to set forth a special prestressed-beam structural member which can be composed of materials other than wood per se, while still utilizing the same special methodology being set forth herein. For example, instead of wood, a new composition concrete and plastic, or composition wood-chips and plastic may be discovered to be a satisfactory substitute for natural wood; while still achieving substantially the same end result from a structural standpoint.

DESCRIPTION OF THE PREFERRED EMBODIMENT DRAWINGS

The foregoing and still other objects of this invention will become fully apparent, along with various advantages and features of novelty residing in the persent embodiments, from study of the following description of the variant generic species embodiments and study of the ensuing description of these embodiments. Wherein indicia of reference are shown to match related points given in the text, as well as the claims section annexed hereto; and accordingly, a better understanding of the invention and the variant uses is intended, by reference to the drawings, which are considered as primarily exemplary and not to be therefore construed as restrictive in nature.

FIG. 1, is a pictorial perspective view looking slightly toward one end of the fully assembled beam member, including phantom indication of a truss element therein.

FIG. 2, is a side-elevation view thereof, shown in reduced scale to better exhibit the usual elongated proportions.

FIG. 3, is an enlarged left end view multi-truss, including progressively stepped ply laminant cut-aways to expose preferred embodiment construction thereof.

FIG. 4, is a top plan-view revealing similar truss-elements, but in stepped cut-away portions for added clarity.

FIG. 5, is a generic variant species of the preferred embodiment, showing an alternate use of a truss-pin device.

FIG. 6, is a generic variant species of the preferred embodiment, showing optional use of stabilizing collar devices.

FIG. 7, is an end elevation-view rotated 90-degrees CCW, displaying a typical rectangular cross-sectional shape, and showing additional generic variations of the invention.

FIG. 8, is an end elevation-view substantially according to FIG. 5.

ITEMIZED NOMENCLATURE REFERENCES

10—the overall invention
11,12,13,14,15—wood ply laminations
16—top of beam
17—bottom of beam
18'/18"—opposite beam side surfaces
19'/19"—opposite beam end surfaces
20'/20"—opposed end relief notches
21,22,23,24—truss element members
25—deflected drape apex region
26'/26"—opposed threaded trunions
27—conventional threaded-nuts
28—transverse bearing plates (or heavy washers)
29'/29"—compression stanchion surface
30—design-load direction indicators
31,32,33,34—truss receptacle channels
35—exemplified cut-off reference line
36/36'—wide formed channel w/optional drilling
37—truss-pin
38-38'/38"—two-piece L-shaped collar/and assembled
39-39/39'"—two-piece U-shaped collar/and weldments
40—annular recess
41,42,43,44—fabrication bonding seams

DETAILED DESCRIPTION OF THE PREFERRED EMBODIMENTS

Initial reference is given by way of FIG. 1, wherein is exhibited a fully assembled example of this invention, and wherein is indicated only one truss-element 21 which would preferably be contained in the indicated ply-lamination layer 13 so as to essentially centralize the tension loads imposed upon the stanchion surface points 29′ and 29″ thereto. Notice here that the four beam lamination-seams between each adjoining laminant layer 11, 12, 13, 14, 15 are achieved via various known bonding methology.

Reference to FIG. 2 reveals how the laminations of this structural member are oriented so that the top 16 and bottom 17 define the width of the typical ply laminal, while the distance from side 18′ to side 18″ defines the aggregate thickness of the laminations. Thus, it can be seen that the usual method of applying load so as to employ the different plys in an aggregate resistive bending manner is not being utilized. Here, the beam material is primarily providing a stable medium for applying a compressive load at the oposed stanchion pads 29′ and 29″, which owing to the well known truss element principle, results in an upward reactive thrust component especially concentrated at the central truss drape-deflection apex region 25; thereby very efficiently maintaining applied loads 30(here imposing a downward deflectional load bearing component) far beyond that which would be expected from an ordinary laminated beam(which is generally about twice as strong in bending as an equivalent one-piece wooden-beam). Note also, that while most applications of this structural member may be found in use as floor and ceiling joists, the same structural advantage can be applied quite effectively in vertical support beams and such. One example of using this beam to great advantage, would be as a header-beam in a wide-span(unsupported) entryway, where the overhead loads are considerable, yet one is desirous of maintaining a high head-clearance in a relatively low ceiling-height situation.

This prestressed/Laminated-beam can sustain such relatively high loads 30, that it can be built up into the archway in this example, so that it appears the ceiling flows from one room into the next without special concern. Another application advantage example, would be where considerable unsupported spans are desired in a building where it is critical to meet a multi-story height limitation. Saving of say 6-inches per floor, can amount to several feet in overall accumulated height.

Moreover, if any future sagging effect were ever observed by careful measurement, then one can readjust the truss tension load higher until the beam surface 16 is level. likewise, careful readjustment of the different tension elements 31, 32, 33, 34 as shown in FIG. 4 will also act to pull a slight warp bend toward one side or the other back into straight alignment. This is a very unique quality not heretofore known to be possible in a structural member. Conventional laminated-beams by way of contrast, achieve a 300% increase in structural resistance to bending when the seam-laminations run in a plane set at a right-angle to the direction of the load component(hence, parallel to the floor when used as floor-joists).

Study of FIG. 3 reveals here how three exemplified truss channels 31, 32, 33 are interposed into the side-walls of respective beams 14, 13 and 12, so that the thrust of the tensioned truss elements 21, 22, and 23, are each applied along the upper surface of the said channel. The channels may be milled-in by means of a hand-router or dado-sawblade, or via an elaborate computer-controled table-mill for real production economy. Depth of the truss channel need only be the guage thickness of the truss element itself, for example a ½-inch round steel bar truss would dictate a nominal channel depth of about 9/16″ as ample allowance. The truss elements may be round or square in cross-section with a truss-channel of matching cross-section, but some producers may even resort to use of other truss element materials such as stranded steel or fiberglass cable. While the preferred embodiment shows the expedient of simple threaded ends to form trunion-stud for application of a retainer-nut bearing upon an end-plate or washer 28; other known methods may be employed such as at one end welding of a bent-over end to the end-plate, clamping at one end, etc. Note also, that the plate or washer 28 bears against the stanchion surface 29′ at an approximate right-angle to the linear deflection-angle of mostly concealed truss-element 21.

Reference to FIG. 5 shows an alternate method by which to install the truss element 31. Here we see a relatively wide truss channel 36 which does not really itself bear loading of the truss element 31, although it is preferred to neck down to what can even be a drilled hole at region 36′. In this example, the tranversely oriented truss-pin 37 bears the primary load, although a plurality of such pins may be employed if desired.

In order to facilitate still greater beam stressing capability, FIG. 6 shows how it is in some instances desirable to mill-in a 5/32-inch deep×3″-wide(will vary with stresses and beam dimensions involved) 40, and install a stabilizing collar easiest built-up from two identical pieces of L-shaped mild steel perhaps ⅛″-guage. Assembled by welding at each diagonal edge as shown at 38″, these collars act to prevent any possible event of delamination failure, and may most effectively be installed at opposite ends and at the center as is suggested in FIG. 6.

FIG. 7 shows the equivalent use of two U-shaped members 39 and 39′ to be bolted together or welded at points 39″ without the flush recess 40. Additionally, the mid-way cut-away portion at the right clearly reveals how the four exemplified truss elements 21, 22, 23, 24, are retained permanently within their respective truss-channels 31, 32, 33, 34. The illustration of FIG. 8 shows how the earlier disclosed truss-pin 37 is positioned relative to the right-angle orientation of the laminations.

Accordingly, it is understood that the utility of the foregoing adaptations of this invention are not dependent upon any prevailing invention patent necessarily; and while the present invention has been well described hereinbefore by way of preferred embodiments,—it is to be realized that various changes, alterations, rearrangements, and obvious modifications may be resorted to by those skilled in the art to which it relates, without substantially departing from the implied spirit and scope of the instant invention. Therefore, the invention has been disclosed herein by way of example, and hence not by thus imposed limitation.

What is claimed of proprietary inventive origin is:

1. A prestressed post-tensioned type architectural structural member, serving as a beam, column, and the like, and generally of elongated formation having a rectangular cross-sectional shape comprising opposing upper and lower surfaces and longitudinally opposed ends featuring improved positioning of truss-element terminuses so as to facilitate pre-installation trimming convenience; comprising: a fabricated multi-ply vertically permanent laminated construction, including at least one longitudinally arranged drape-deflected post-tensionable truss-element set at a desired linear deflection angle from said upper surface into a provisional retaining channel made therein at least one of said vertical laminations, thereby serving to substantially conceal said truss-element except for said opposed terminuses which emerge near the opposed beam ends in local relief notches atop the beam's said rectangular cross-section; and including longitudinally opposed end coupling fixture means by which to securely tighten said truss-element in a prestressed manner.

2. A prestressed beam according to claim 1, wherein additional said truss-elements may be each likewise discretely interposed into various said vertical laminae thereof, each thereby separated by a ply of the said laminated beam.

3. A prestressed beam according to claim 1, wherein said retaining channel is stabilized by presence of an adjacent ply lamination, and may describe a drape-deflection bearing profile of any given design preference; a wooden ridge created by said channel serving as means by which actual upward thrust component of the truss effect is attained.

4. A prestressed beam according to claim 1, wherein said truss-element may be a tensionable rod or stranded-cable of substantially conventional character, moored at each near end region atop said rectangular beam cross-section, including at least one end threaded trunion stud thereto, for post application and regulation of post tension.

5. A prestressed beam according to claim 1, wherein said opposed end coupling fixtures are made up from washer-plates or transverse bearing-plate members set into opposed notch like stanchion recesses made into the top surface of the beam near each beam longitudinal end, said stanchion's bearing face set at an approximate right angle to the linear deflection angle of said truss-element's respective terminuses.

* * * * *